US010276942B2

(12) United States Patent
Li et al.

(10) Patent No.: US 10,276,942 B2
(45) Date of Patent: Apr. 30, 2019

(54) HELICAL ANTENNA AND METHOD OF MODULATING THE PERFORMANCE OF A WIRELESS COMMUNICATIONS DEVICE

(71) Applicant: The Board of Trustees of the University of Illinois, Urbana, IL (US)

(72) Inventors: Xiuling Li, Champaign, IL (US); Wen Huang, Champaign, IL (US); Paul J. Froeter, Urbana, IL (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 122 days.

(21) Appl. No.: 15/408,893

(22) Filed: Jan. 18, 2017

(65) Prior Publication Data

US 2017/0207522 A1 Jul. 20, 2017

Related U.S. Application Data

(60) Provisional application No. 62/280,160, filed on Jan. 19, 2016.

(51) Int. Cl.

| | |
|---|---|
| ***H01Q 1/36*** | (2006.01) |
| ***H01Q 11/08*** | (2006.01) |
| ***H01Q 21/00*** | (2006.01) |
| ***H01Q 21/06*** | (2006.01) |

(52) U.S. Cl.

CPC ..... *H01Q 11/08* (2013.01); *H01Q 21/0087* (2013.01); *H01Q 21/061* (2013.01)

(58) Field of Classification Search

CPC ... H01Q 11/08; H01Q 21/0087; H01Q 21/061
See application file for complete search history.

(56) References Cited

U.S. PATENT DOCUMENTS

| | | | |
|---|---|---|---|
| 3,247,476 | A | 4/1966 | Pintell |
| 4,755,783 | A | 7/1988 | Fleischer et al. |
| 5,844,460 | A | 12/1998 | Bogdan et al. |
| 6,271,802 | B1 | 8/2001 | Clark et al. |
| 7,330,096 | B2 | 2/2008 | Shah et al. |

(Continued)

FOREIGN PATENT DOCUMENTS

| | | | |
|---|---|---|---|
| EP | 2 423 162 | A1 | 2/2012 |
| WO | WO 2016083227 | A1 | 6/2016 |

OTHER PUBLICATIONS

Balanis, "Antenna Theory Analysis and Design", Wiley Interscience, 3rd Edition, 2005, pp. 566-576.*

(Continued)

*Primary Examiner* — Dameon E Levi
*Assistant Examiner* — David E Lotter
(74) *Attorney, Agent, or Firm* — Brinks Gilson & Lione

(57) ABSTRACT

A wireless communication device includes an array of helical antennas on a substrate. Each helical antenna comprises a strain-relieved sheet with a conductive strip thereon, where the strain-relieved sheet and the conductive strip are in a rolled configuration about a longitudinal axis. The conductive strip is oriented at an angle α with respect to a rolling direction so as to comprise a helical configuration about the longitudinal axis with a non-zero helix angle β. The array exhibits a maximum gain of at least about 10 dB at a working frequency of at least about 0.1 THz.

11 Claims, 12 Drawing Sheets
(6 of 12 Drawing Sheet(s) Filed in Color)

(56) References Cited

U.S. PATENT DOCUMENTS

| | | | | |
|---|---|---|---|---|
| 7,707,714 | B2 | 5/2010 | Schmidt et al. | |
| 7,710,232 | B1 | 5/2010 | Stalford et al. | |
| 2010/0019868 | A1 | 1/2010 | Hyde et al. | |
| 2011/0163932 | A1 | 7/2011 | Mosbacker | |
| 2014/0104030 | A1* | 4/2014 | Li | H01L 23/645 336/220 |
| 2015/0099116 | A1 | 4/2015 | Li et al. | |
| 2016/0301377 | A1 | 10/2016 | Li et al. | |

OTHER PUBLICATIONS

Ali, M.S. Mohamed et al., "Out-of-plane spiral-coil inductor self-assembled by locally controlled bimorph actuation," *Micro & Nano Letters*, 6, 12 (2011) pp. 1016-1018.

Arora, William J. et al., "Membrane folding to achieve three-dimensional nanostructures: Nanopatterned silicon nitride folded with stressed chromium hinges," *Applied Physics Letters*, 88, 053108 (2006) pp. 053108-1-053108-3.

Bianucci, P. et al., "Self-Organized 1.55 μm InAs/InP Quantum Dot Tube Nanoscale Coherent Light Sources," *Winter Topicals (WTM) IEEE, Conference Publication* (2011), pp. 127-128.

Bof Bufon, Carlos César et al., "Self-Assembled Ultra-Compact Energy Storage Elements Based on Hybrid Nanomembranes," *Nano Letters*, 10 (2010) pp. 2506-2510.

Bogush, V. et al., "Electroless deposition of novel Ag-W thin films," *Microelectronic Engineering*, 70 (2003) pp. 489-494.

Chen, Daru et al., "A novel low-loss Terahertz waveguide: Polymer tube," *Optics Express*, 18, 4 (2010) pp. 3762-3767.

Chun, Ik Su et al., "Controlled Assembly and Dispersion of Strain-Induced InGaAs/GaAs Nanotubes," *IEEE Transactions on Nanotechnology*, 7, 4 (2008) pp. 493-495.

Chun, I.S. et al., "InGaAs/GaAs 3D architecture formation by strain-induced self-rolling with lithographically defined rectangular stripe arrays," *Journal of Crystal Growth*, 310 (2008) pp. 2353-2358.

Chun, Ik Su et al., "Geometry Effect on the Strain-Induced Self-Rolling of Semiconductor Membranes," *Nano Letters*, 10 (2010) pp. 3927-3932.

Dai, Lu et al., "Directional scrolling of SiGe/Si/Cr nanoribbon on Si(111) surfaces controlled by two-fold rotational symmetry underetching," *Nanoscale*, 5 (2013) pp. 971-976.

Dai, L. et al., "Strain-driven self-rolling mechanism for anomalous coiling of multilayer nanohelices," *Journal of Applied Physics*, 106, 114314 (2009) pp. 114314-1-114314-5.

Dean Jr., Robert N., et al., "3-D Helical THz Antennas," *Microwave and Optical Technology Letters*, 24, 2 (2000), pp. 106-111. (Abstract Only).

Doerner, M. et al., "Stresses and Deformation Processes in Thin Films on Substrates," *CRC Critical Reviews in a Solid State and Materials Sciences*, 14, 3 (1988) pp. 224-268.

Du, Frank et al., "Aligned arrays of single walled carbon nanotubes for transparent electronics," *Proceedings of SPIE*, 8725 (2013) pp. 87251S-1-87251S-7.

Frankel, Michael Y., "Terahertz Attenuation and Dispersion Characteristics of Coplanar Transmission Lines," *IEEE Transactions on Microwave Theory and Techniques*, 39, 6 (1991), pp. 910-916.

Golod, S. V. et al., "Fabrication of conducting GeSi/Si micro- and nanotubes and helical microcoils," *Semiconductor Science and Technology*, 16 (2001) pp. 181-185.

Golod, S.V. et al., "Freestanding SiGe/Si/Cr and SiGe/Si/$Si_xN_y$/Cr Microtubes," *Applied Physics Letters*, 84, 17 (2004) pp. 3390-3393.

Gorin, A. et al., "Fabrication of silicon nitride waveguides for visible-light using PECVD: a study of the effect of plasma frequency on optical properties," *Optics Express*, 16, 18 (2008) pp. 13509-13516.

Harazim, Stefan M. et al., "Fabrication and applications of large arrays of multifunctional rolled-up SiO/$SiO_2$ microtubes," *Journal of Materials Chemistry*, 22, 7 (2012) pp. 2878-2884.

Heiliger, H.-M. et al., "Low-dispersion thin-film microstrip lines with cyclotene (benzocyclobutene) as dielectric medium," *Applied Physics Letters*, 70, 17 (1997) pp. 2233-2235.

Hsu, Heng-Ming, et al., "Design of Coil Length of On-Chip Transformer with High Turn Ratio and High Coupling Performance," *IEEE Transactions on Electron Devices*, 59, 11 (2012) pp. 3061-3068.

Huang, G. S. et al., "Optical properties of rolled-up tubular microcavities from shaped nanomembranes," *Applied Physics Letters*, 94, 141901 (2009) 141901-1-141901-3.

Huang, Minghuang et al., "Nanomechanical Architecture of Strained Bilayer Thin Films: From Design Principles to Experimental Fabrication," *Advanced Materials*, 17 (2005) pp. 2860-2864.

Huang, Gaoshan et al., "Thinning and Shaping Solid Films into Functional and Integrative Nanomembranes," *Advanced Materials*, 24 (2012) pp. 2517-2546.

Huang, Gaoshan et al., "Rolled-up transparent microtubes as two-dimensionally confined culture scaffolds of individual yeast cells," *Lab Chip*, 9 (2009) pp. 263-268.

Huang, Minghuang et al., "Mechano-electronic Superlattices in Silicon Nanoribbons," *ACS Nano*, 3, 3 (2009) pp. 721-727.

Inberg, A. et al., "Novel Highly Conductive Silver-Tungsten Thin Films Electroless Deposited from Benzoate Solution for Microelectronic Applications," *Journal of the Electrochemical Society*, 150, 5 (2003) pp. C285-C291.

Ishigaki, Tsukasa et al., "Photonic-Crystal Slab for Terahertz-Wave Integrated Circuits," *Photonics Conference (IPC) IEEE, Conference Publication* (2012) pp. 774-775.

Jan, C.-H. et al., "A 32nm SoC Platform Technology with 2nd Generation High-k/Metal Gate Transistors Optimized for Ultra Low Power, High Performance, and High Density Product Applications," *IEEE*, (2009) pp. 647-650.

Jiang, Hongrui et al., "On-Chip Spiral Inductors Suspended over Deep Copper-Lined Cavities," *IEEE Transactions on Microwave Theory and Techniques*, 48, 12 (2000) pp. 2415-2423.

Karnaushenko, Dmitriy D., et al., "Compact Helical Antenna for Smart Implant Applications," *NPG Asia Materials*, 7 (2015) pp. e1888-1-e1888-10.

Kobayashi, Toshiyuki et al., "Production of a 100-m-Long High-Quality Graphene Transparent Conductive Film by Roll-to-Roll Chemical Vapor Deposition and Transfer Process," *Applied Physics Letters* 102 (2013) pp. 023112-1-023112-4.

Li, Feng et al., "Coherent emission from ultrathin-walled spiral InGaAs/GaAs quantum dot microtubes," *Optics Letters*, 34, 19 (2009) pp. 2915-2917.

Li, Weizhi et al., "Influences of Process Parameters of Low Frequency PECVD Technology on Intrinsic Stress of Silicon Nitride Thin Film," *Proc. of SPIE*, 7658 (2010) pp. 765824-1-765824-7.

Li, Xiuling, "Self-rolled-up microtube ring resonators: a review of geometrical and resonant properties," *Advances in Optics and Photonics*, 3 (2011) pp. 366-387.

Li, Xiuling, "Strain induced semiconductor nanotubes: from formation process to device applications," *Journal of Physics D: Applied Physics*, 41 (2008) 193001, pp. 1-12.

Li, Xuesong et al., "Transfer of Large-Area Graphene Films for High-Performance Transparent Conductive Electrodes," *Nano Letters*, 9, 12 (2009) pp. 4359-4363.

Logeeswaran, V. J. et al., "Ultrasmooth Silver Thin Films Deposited with a Germanium Nucleation Layer," *Nano Letters*, 9, 1 (2009) pp. 178-182.

Luchnikov, V. et al., "Toroidal hollow-core microcavities produced by self-rolling of strained polymer bilayer films," *Journal of Micromechanics and Microengineering*, 18 (2008) 035041, pp. 1-5.

Luo, J. K. et al., "Modelling and fabrication of low operation temperature microcages with a polymer/metal/DLC trilayer structure," *Sensors and Actuators A*, 132 (2006) pp. 346-353.

Masi, Maurizio et al., "Modeling of Silicon Nitride Deposition by RF Plasma-Enhanced Chemical Vapor Deposition," *Chemical Engineering Science*, 49, 5 (1994) pp. 669-679.

Mei, Yongfeng et al., "Versatile Approach for Integrative and Functionalized Tubes by Strain Engineering of Nanomembranes on Polymers," *Advanced Materials*, 20 (2008) pp. 4085-4090.

(56) References Cited

OTHER PUBLICATIONS

Mi, Zetian et al., "1.3-1.55 μm Self-Organized InAs Quantum Dot Tube Nanoscale Lasers on Silicon," *Photonics Conference (PHO), IEEE, Conference Publication* (2011) pp. 535-536.
Mitrofanov, Oleg et al., "Reducing Transmission Losses in Hollow THz Waveguides," *IEEE Transactions on Terahertz Science and Technology*, 1, 1 (2011) pp. 124-132.
Mitrofanov, Oleg et al., "Dielectric-lined cylindrical metallic THz waveguides: mode structure and dispersion," *Optics Express*, 18, 3 (2010) pp. 1898-1903.
Moiseeva, E. et al., "Single-mask microfabrication of three-dimensional objects from strained bimorphs," *Journal of Micromechanics and Microengineering*, 17 (2007) pp. N63-N68.
Müller, Christian et al., "Tuning giant magnetoresistance in rolled-up Co—Cu nanomembranes by strain engineering," *Nanoscale*, 4 (2012) pp. 7155-7160.
Nguyen, Nhat M. et al., "Si IC-Compatible Inductors and LC Passive Filters," *IEEE Journal of Solid-State Circuits*, 25, 4 (1990) pp. 1028-1031.
Pahlevaninezhad, H. et al., "Advances in Terahertz Waveguides and Sources," *IEEE Photonics Journal*, 3, 2 (2011) pp. 307-310.
Pang, Liang et al., "Transfer printing of flexible hybrid inductor-capacitor filters via pre-etched silicon-on-insulator mother wafer," *Applied Physics Letters*, 101, 063113 (2012) pp. 063113-1-063113-4.
Park, Min et al., "The Detailed Analysis of High Q CMOS-Compatible Microwave Spiral Inductors in Silicon Technology," *IEEE Transactions on Electron Devices*, 45, 9 (1998) pp. 1953-1959.
Parvizian, M. et al., "Residual stress improvement of platinum thin film in Au/Pt/Ti/p—GaAs ohmic contact by RF sputtering power," *Applied Surface Science*, 260 (2012) pp. 77-79.
Prinz, V. Ya. et al., "Free-standing and overgrown InGaAs/GaAs nanotubes, nanohelices and their arrays," *Physica E*, 6 (2000) pp. 828-831.
Rottler, Andreas et al., "Rolled-up nanotechnology for the fabrication of three-dimensional fishnet-type GaAs-metal metamaterials with negative refractive index at near-infrared frequencies," *Applied Physics Letters*, 100, 151104 (2012) pp. 151104-1-151104-4.
Schulze, Sabine et al., "Morphological Differentiation of Neurons on Microtopographic Substrates Fabricated by Rolled-Up Nanotechnology," *Advanced Engineering Materials*, 12, 9 (2010), pp. B558-B564.
Seidel, H. et al., "Anisotropic Etching of Crystalline Silicon in Alkaline Solutions," *J. Electrochem. Soc.*, 137, 11 (1990) pp. 3612-3632.
Seleznev, V. A. et al., "Generation and Registration of Disturbances in a Gas Flow. 1. Formation of Arrays of Tubular Microheaters and Microsensors," *Journal of Applied Mechanics and Technical Physics*, 50, 2 (2009) pp. 291-296.
Shacham-Diamand, Yosi et al., "Electroless Silver and Silver with Tungsten Thin Films for Microelectronics and Microelectromechanical System Applications," *Journal of the Electrochemical Society*, 147, 9 (2000) pp. 3345-3349.
Shiplyuk, A. N. et al., "Generation and Registration of Disturbances in a Gas Flow. 2. Experiments with Arrays of Tubular Microheaters and Microsensors," *Journal of Applied Mechanics and Technical Physics*, 50, 3 (2009) pp. 454-458.
Smith, Donald L. et al., "Mechanism of $SiN_xH_y$ Deposition from $NH_3$—$SiH_4$ Plasma," *J. Electrochem. Soc.*, 137, 2 (1990) pp. 614-623.
Smith, Elliot J. et al., "Lab-in-a-Tube: Detection of Individual Mouse Cells for Analysis in Flexible Split-Wall Microtube Resonator Sensors," *Nano Letters*, 11 (2011) pp. 4037-4042.
Songmuang, R. et al., "From rolled-up Si microtubes to $SiO_x$/Si optical ring resonators," *Microelectronic Engineering*, 84 (2007) pp. 1427-1430.
Tang, Chih-Chun et al., "Miniature 3-D Inductors in Standard CMOS Process," *IEEE Journal of Solid-State Circuits*, 37, 4 (2002) pp. 471-480.
Tian, Dongbin et al., "Dual cylindrical metallic grating-cladding polymer hollow waveguide for terahertz transmission with low loss," *Applied Physics Letters*, 97, (2010) pp. 133502-1-133502-3.
Tian, Zhaobing et al., "Controlled Transfer of Single Rolled-Up InGaAs—GaAs Quantum-Dot Microtube Ring Resonators Using Optical Fiber Abrupt Tapers," *IEEE Photonics Technology Letters*, 22, 5 (2010) pp. 311-313.
Tian, Zhaobing et al., "Single rolled-up InGaAs/GaAs quantum dot microtubes integrated with silicon-on-insulator waveguides," *Optics Express*, 19, 13 (2011) pp. 12164-12171.
Timoshenko, S., "Analysis of Bi-Metal Thermostats," *Journal of the Optical Society of America*, 11 (1925) pp. 233-255.
Walmsley, Byron A. et al., "Poisson's Ratio of Low-Temperature PECVD Silicon Nitride Thin Films," *Journal of Microelectromechanical Systems*, 16, 3 (2007) pp. 622-627.
Wang, To-Po et al., "High-Q Micromachined Inductors for 10-to-30-GHz RFIC Applications on Low Resistivity Si-Substrate," *Proceedings of the 36th European Microwave Conference*, (2006) pp. 56-59.
Wheeler, Harold A., "Formulas for the Skin Effect," *Proceedings of the I.R.E.*, (1942) pp. 412-424.
Wiemer, L. et al., "Determination of Coupling Capacitance of Underpasses, Air Bridges and Crossings in MICs and MMICs," *Electronics Letters*, 23, 7 (1987) pp. 344-346.
Xu, Xiangdong et al., "Chemical Control of Physical Properties in Silicon Nitride Films," *Appl. Phys. A.*, 111 (2013) pp. 867-876.
Yue, C. Patrick et al., "A Physical Model for Planar Spiral Inductors on Silicon," *IEEE, IEDM*, 96 (1996) pp. 155-158.
Yue, C. Patrick et al., "Physical Modeling of Spiral Inductors on Silicon," *IEEE Transactions on Electron Devices*, 47, 3 (2000) pp. 560-568.
Yu, Minrui et al., "Semiconductor Nanomembrane Tubes: Three-Dimensional Confinement for Controlled Neurite Outgrowth," *ACS Nano*, 5, 4 (2011) pp. 2447-2457.
Zang, Ji et al., "Mechanism for Nanotube Formation from Self-Bending Nanofilms Driven by Atomic-Scale Surface-Stress Imbalance," *Physical Review Letters*, 98, (2007) pp. 146102-1-146102-4.
Zolfaghari, Alireza et al., "Stacked Inductors and Transformers in CMOS Technology," *IEEE Journal of Solid-State Circuits*, 36, 4 (2001) pp. 620-628.

* cited by examiner

HELICAL ANTENNA AND METHOD OF MODULATING THE PERFORMANCE OF A WIRELESS COMMUNICATIONS DEVICE

RELATED APPLICATIONS

The present patent document claims the benefit of priority under 35 U.S.C. § 119(e) to U.S. Provisional Patent Application Ser. No. 62/280,160, filed on Jan. 19, 2016, which is hereby incorporated by reference in its entirety.

FEDERALLY SPONSORED RESEARCH OR DEVELOPMENT

This invention was made with government support under contract number 1449548 awarded by the National Science Foundation (NSF) and contract number DE-FG0207ER46471 awarded by the Department of Energy (DOE). The government has certain rights in the invention.

TECHNICAL FIELD

The present disclosure is related generally to rolled-up device architectures and more specifically to helical antennas.

BACKGROUND

An antenna is an electrical device designed to convert electrical signals into radio waves or electromagnetic (EM) waves, and vice versa, for a given frequency band. Antennas are widely used in systems that utilize EM waves for carrying signals, such as cell phones, radar, satellite communication, as well as other devices such as wireless computer networks, wireless wearable devices and radiofrequency identification (RFID) tags on merchandise. To satisfy a range of device working frequencies and applications, a large number of different types of antenna have been developed and commercialized since 1895. Antennas are typically constructed from conductive wires that are electrically connected to a receiver or transmitter by a transmission line. When an oscillating current signal is fed into the wire, an oscillating magnetic field is created around the antenna. In addition, the oscillating magnetic field creates an oscillating electric field, and thus a time-varying field radiates away from the antenna into space. The frequency of the radiation signal may be inversely proportional to the size of the antenna, such that smaller devices lead to higher working frequencies.

Almost all the current antenna designs focus on frequencies below the terahertz (THz, $10^{12}$ Hz) band, which may be defined to extend from 0.1 THz to 10 THz. The THz band is considered to be an important part of the EM spectrum as it includes frequencies with numerous potential physical and chemical applications. However, for a long time, due to the unavailability of powerful THz sources, transmission lines, detectors and other components, this band remained untapped and has become known as the "terahertz gap." During the past decade, various THz components and instruments have been developed to bridge this gap.

There is demand for a high performance THz antenna in applications where THz EM energy needs to be radiated or received. One example is the future high data rate communication system. A data rate of more than 100 Gbps for outdoor communication and more than 40-100 Gbps for indoor communication can be obtained by increasing the operating frequency to the THz band, so that even with a narrow bandwidth, the data rate may be high enough for target applications. Unfortunately, the atmospheric path loss at the THz band is significant, and thus high-power sources, efficient detectors and a high gain THz antenna are being developed to overcome the problem. Due to the limitations of current power sources and detectors, however, high gain THz antennas may need to play a more important role in realizing advanced wireless systems.

BRIEF SUMMARY

A helical antenna for terahertz (THz) band applications comprises a strain-relieved sheet with a conductive strip thereon, where the strain-relieved sheet and the conductive strip are in a rolled configuration about a longitudinal axis. The conductive strip is oriented at an angle $\alpha$ with respect to a rolling direction so as to comprise a helical configuration about the longitudinal axis with a non-zero helix angle $\beta$. An inner diameter of the rolled configuration is about 100 microns or less, and the helical antenna comprises a working frequency of at least about 0.1 THz.

A wireless communication device includes an array of helical antennas on a substrate. Each helical antenna comprises a strain-relieved sheet with a conductive strip thereon, where the strain-relieved sheet and the conductive strip are in a rolled configuration about a longitudinal axis. The conductive strip is oriented at an angle $\alpha$ with respect to a rolling direction so as to comprise a helical configuration about the longitudinal axis with a non-zero helix angle $\beta$. The array exhibits a maximum gain of at least about 10 dB at a working frequency of at least about 0.1 THz.

A method of fabricating a helical antenna for terahertz (THz) band applications includes forming a strained sheet comprising a material compatible with integrated circuit (IC) processing on a supporting surface of a substrate. A conductive strip having a misalignment angle $\alpha$ with respect to a rolling direction is formed on the strained sheet. A portion of the substrate is etched, thereby releasing an end of the strained sheet and allowing the strained sheet with the conductive strip thereon to roll up along the rolling direction to relieve strain. Thus, a strain-relieved sheet with the conductive strip thereon is formed in a rolled configuration about a longitudinal axis, where the conductive strip comprises a helical configuration about the longitudinal axis with a non-zero helix angle $\beta$.

A method of modulating the performance of a wireless communications device includes inducing a change in conformation of one or more helical antennas on a supporting surface of a substrate. Each helical antenna comprises a strain-relieved sheet including a conductive strip thereon, where the strain-relieved sheet and the conductive strip are in a rolled configuration about a longitudinal axis. The conductive strip is oriented at an angle $\alpha$ with respect to a rolling direction so as to comprise a helical configuration about the longitudinal axis with a non-zero helix angle $\beta$. Inducing the change in conformation comprises altering an inner diameter, pitch, and/or length of at least one of the helical antennas, and/or altering a spacing between adjacent helical antennas. Consequently, a performance parameter of the one or more helical antennas, such as working frequency or gain, may be controlled.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION

Figure 1A:
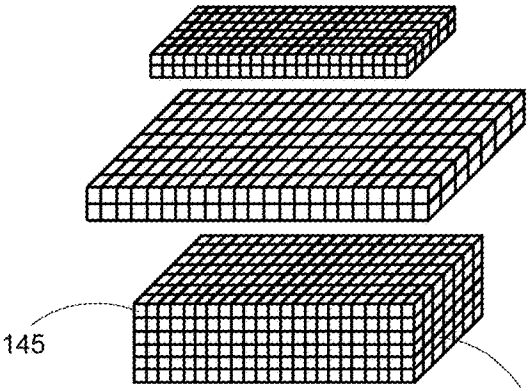
FIGS. 1A-1D are schematics showing self-rolled-up membrane (S-RuM) technology.
Figure 1B:
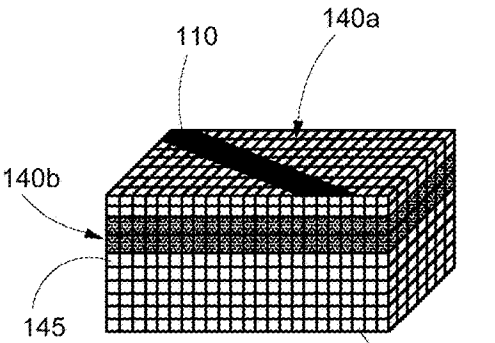
Figure 1C:
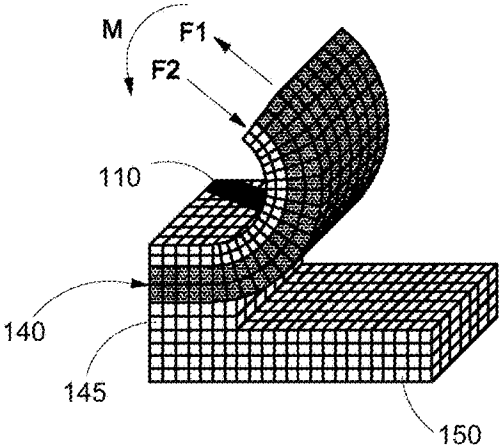
Figure 1D:
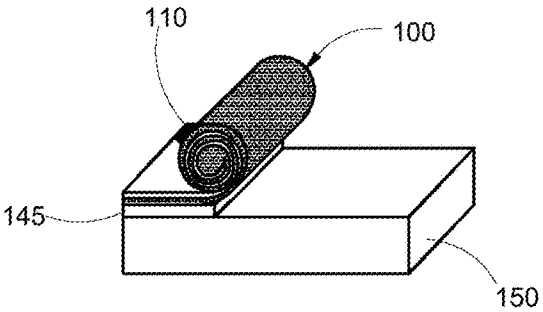

Microscale helical antennas having a working frequency in the THz range and applications in wireless communications are described herein. The helical antennas are fabricated by strain-induced roll-up of thin films, which may be referred to as self-rolled-up membrane (S-RuM) technology. Also described are methods to tune the conformation of individual antennas and arrays of the antennas.

First, an introduction to the self-rolling concept is provided in reference to FIGS. 1A-1D, which are schematic illustrations and not to scale. Microscale rolled-up tubular device structures form spontaneously when strained planar sheets or membranes deform as a consequence of energy relaxation. A strained sheet 140 may comprise an oppositely strained bilayer (e.g., a top layer 140*a* in tension on a bottom layer 140*b* in compression), which may be in contact with a sacrificial layer 145 on a substrate 150. The strained sheet 140 may be released from the substrate 150 when the sacrificial layer 145 is etched away. Once released, the opposing strain within the sheet 140 generates a net momentum, driving the planar sheet 140 to roll up into a tubular spiral structure 100. Rolled-up structures 100 having microscale diameters may be formed from the strain-relieved sheet 140. Prior to roll-up, one or more thin films may be deposited and optionally patterned on the strained sheet 140 such that the rolled-up structure 100 includes multiple layers and a desired functionality.

Figure 2A:
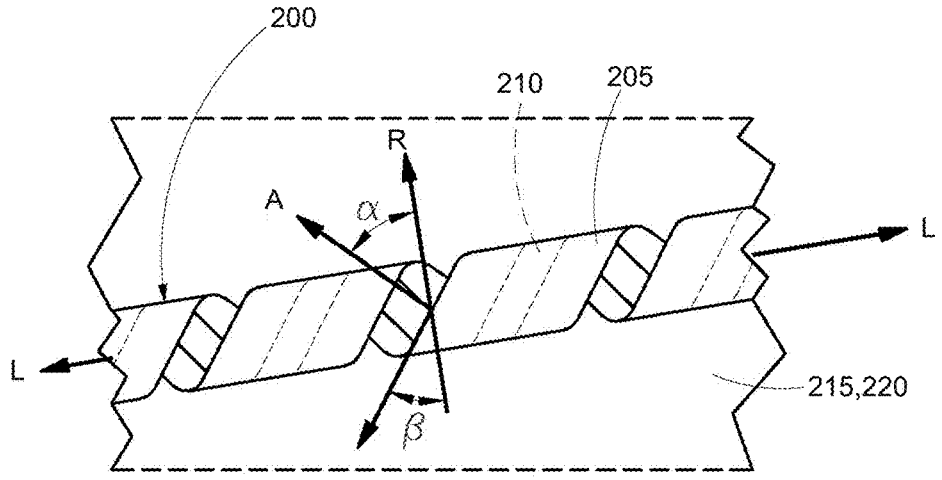
FIGS. 2A and 2B are schematics of exemplary helical antennas.
Figure 2B:
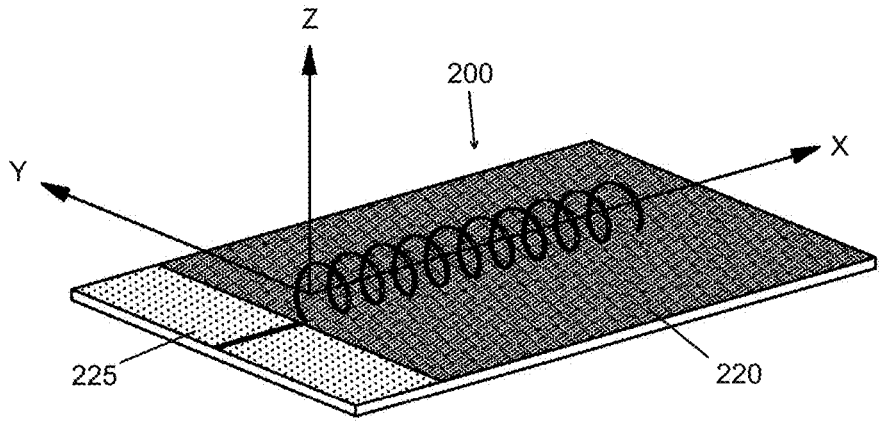

Under certain conditions, it is possible to form rolled-up structures that have a controlled amount of chirality or helicity. For example, as illustrated in FIGS. 1A-1D, the strained sheet 140 may include a patterned conductive layer (e.g., a conductive strip) 110 thereon oriented so as to form a conductive helical structure upon roll-up. On this principle, a helical antenna for terahertz (THz) band applications may be fabricated, as shown in FIGS. 2A and 2B. The helical antenna 200 comprises a strain-relieved sheet 205 with a conductive strip thereon in a rolled configuration about a longitudinal axis L. The conductive strip 210 is oriented at a misalignment angle $\alpha$ with respect to a rolling direction R so as to comprise a helical configuration about the longitudinal axis with a non-zero helix angle $\beta$. The rolling direction R and the longitudinal axis L are perpendicular to each other. The strain-relieved sheet 205 typically comprises an inorganic material compatible with standard integrated circuit (IC) processing, as discussed in detail below. An inner diameter of the rolled configuration is about 100 microns or less and the helical antenna 200 comprises a working frequency of at least about 0.1 THz. The working frequency may also be at least about 1 THz. The inner diameter D and pitch S of the helical antenna 200 may be adjusted after roll-up, as described below. The anticipated relationship between the inner diameter D of the helical antenna and the working frequency range is summarized in Table 1 below.

TABLE 1

Relationship between inner diameter D of S-RuM antenna and working frequency range.

| INNER DIAMETER | Working frequency range |
|---|---|
| <1 μm | >71.6 THz |
| 1 μm~10 μm | >7.16 THz & <71.6 THz |
| 10 μm~100 μm | >71.6 GHz & <7.16 THz |
| 100 μm~1000 μm | >71.6 GHz & <7.16 GHz |
| >1000 μm | <71.6 GHz |

The helical antenna 200 may be disposed on a supporting surface 215 of a substrate 220 such that the longitudinal axis L is substantially parallel to the supporting surface 215. The substrate 220 may be the same substrate on which the roll-up occurred, or the helical antenna 200 may be transferred after roll-up to a different substrate. Any of a wide range of substrates 220 may be employed to support the helical antenna(s), from rigid semiconductor wafers to flexible polymeric substrates.

Figure 3:
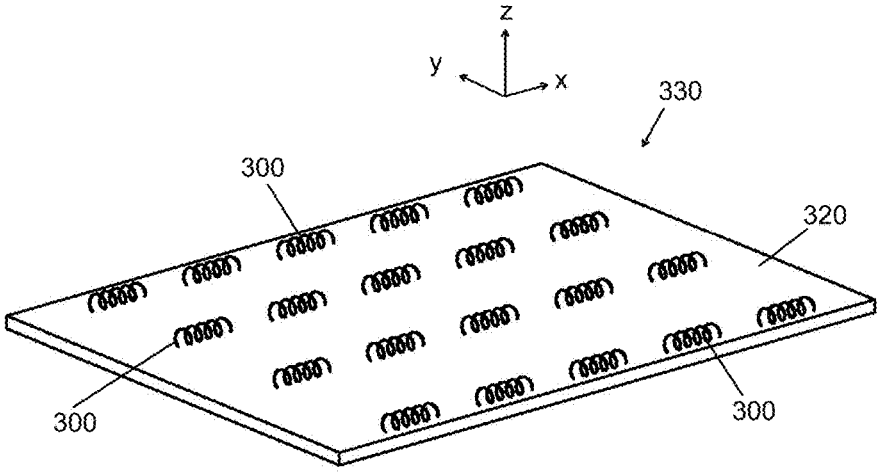
FIG. 3 is a schematic of an exemplary two-dimensional array of helical antennas.

Given the microscale size of the antenna and fabrication from materials compatible with semiconductor processing, the helical antenna may be fabricated on chip using S-RuM technology. As shown in FIG. 2B, a co-planar transmission line 225 formed on the substrate 220, which may be a silicon wafer, may provide an electrical connection from the antenna 200 to a transmitter or receiver. Because of the non-planar morphology of the helical antenna 200, substrate mode effects can be avoided. Other benefits of the helical device include easy impedance matching and high directivity and gain, particularly from an array of helical antennas. Accordingly, as shown schematically in FIG. 3, a wireless communications device 330 may be constructed from an array of helical antennas 300 on a substrate 320, where each helical antenna 300 has any of the characteristics set forth in this disclosure, and where the array 330 exhibits a maximum gain of at least about 10 dB at a working frequency of at least about 0.1 THz. The working frequency may in some cases be at least about 1 THz. The array 330 may have an array pitch (e.g., spacing between adjacent helical antennas 300) from about 1λ to about 2λ, where λ is a working wavelength equivalent to c/v, v being the working frequency and c being the speed of light. Typically, the maximum gain is in the range from about 10 dB to about 20 dB.

Figure 4A:
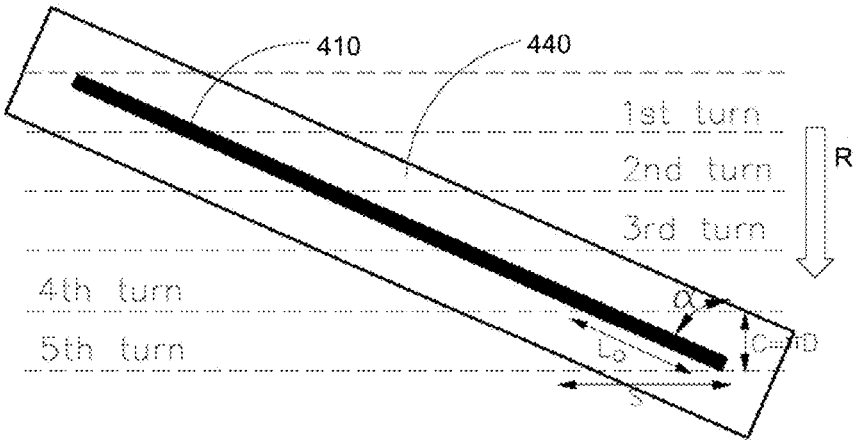
FIGS. 4A and 4B show top-view schematics of exemplary strained sheets 440 prior to roll-up to form helical antennas.
Figure 4B:
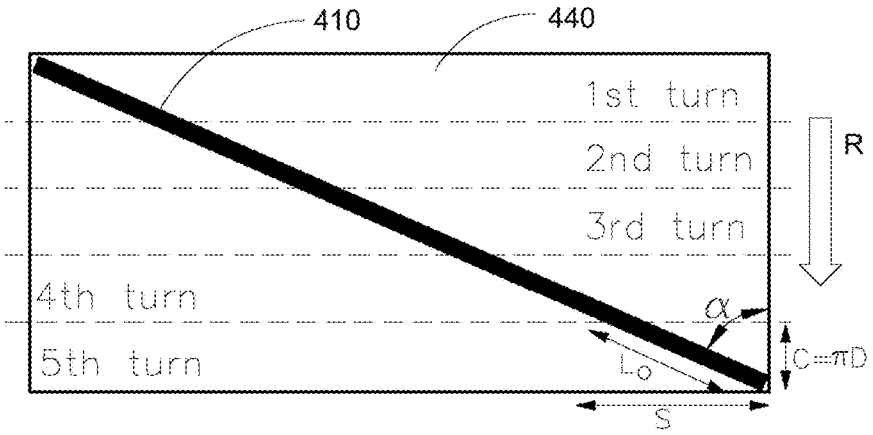

FIGS. 4A and 4B show top-view schematics of exemplary strained sheets 440 prior to roll-up to form helical antennas. It is noted that the sheet 440 on which the conductive strip 410 is formed may be referred to as a strained sheet (prior to rolling) or as a strain-relieved sheet (after rolling). The sheet includes less strain (or no strain) in the rolled configuration than in the initial planar configuration prior to rolling. In the example of FIGS. 1A-1D, the strained sheet 140 is shown to comprise two sublayers, which may be referred to as a bilayer or an oppositely strained bilayer, including a top sublayer 140*a* in tension and a bottom sublayer 140*b* in compression, to facilitate the rolling up shown schematically in FIGS. 1C-1D. Alternatively, having the top sublayer in compression and the bottom sublayer in tension may lead to "rolling down" instead of rolling up.

Returning now to FIG. 4A, it can be seen that the strained sheet 440 has the same orientation on the substrate as the conductive strip 410; in other words, both the strained sheet 440 and the conductive strip 410 are oriented at the angle α with respect to the rolling direction R. In contrast, in FIG. 4B, the strained sheet 440 is oriented along the rolling direction and thus only the conductive strip 410 is oriented at the angle α with respect to the rolling direction R. Because the functionality of the antenna is determined by the conductive strip 410, which adopts the desired helical configuration upon roll-up in both examples, either orientation (or other orientations) of the strained sheet 440 with respect to the rolling direction R may be suitable. It may be advantageous for the strained sheet 440 to have isotropic mechanical properties prior to rolling, at least in a plane parallel to the supporting surface of the substrate, so that the rolling direction R may be determined or at least influenced by the crystallography of the underlying substrate. Accordingly, it may be preferred for the strained sheet 440 to have an amorphous or a non-textured polycrystalline microstructure.

In the examples of FIGS. 4A and 4B, various planar parameters including the number of turns, the length $L_0$ of the conductive strip 410 between turns, and the distances that determine the pitch S and circumference C of the helical antenna, where C=πD, are shown. It is possible to precisely control the inner diameter D of the helical antenna by controlling these planar parameters and the misalignment angle α of the conductive strip 410 with respect to the rolling direction R. In addition, the helicity or chirality of the helical antenna, as represented by the helix angle β and as shown in FIG. 2A, may be determined based on the misalignment angle α of the conductive strip 410 with respect to the rolling direction R. The misalignment angle α may be defined as the orientation of the long axis A of the conductive strip 410 with respect to the rolling direction R prior to rolling. A misalignment angle α of zero means the long axis A of the conductive strip is aligned with the rolling direction R; a misalignment angle α of 90° means the long axis A of the elongate strip is perpendicular to the rolling direction R; in both of these cases, the helix angle β is zero. As explained below, the rolling direction R may correspond to the preferred etch direction of a single crystal substrate (either a bulk substrate or sacrificial layer). The misalignment angle α of the conductive strip prior to rolling may have the same value as the helix angle β of the helical antenna after rolling. A positive or clockwise misalignment angle α leads to a helical antenna having left-handed chirality, while a negative or counterclockwise misalignment angle α leads to a helical antenna having right-handed chirality.

For the helical antennas described herein, the absolute value of the helix angle β and the absolute value of the misalignment angle α are greater than zero and, more specifically, may be from about 1° to less than 90°. Typically, the absolute value of each of the misalignment angle α and the helix angle β is about 5° or greater, about 10° or greater, about 15° or greater, about 20° or greater, or about 25° or greater, and generally no larger than about 80°, no larger than about 60°, or no larger than about 40°. A range from about 10° to about 16° or from about 12° to about 14° may be particularly suitable for the helix angle β of the helical antennas.

The sheet (both strained and strain-relieved) may be fabricated from any of a number of materials, particularly inorganic materials that are compatible with IC processing, such as silicon nitride, silicon oxide, diamond, aluminum oxide, aluminum nitride, boron nitride, magnesium oxide, silicon, chromium, gold and/or titanium. (The term inorganic material as used herein encompasses carbon compounds such as diamond and graphene.) For example, non-stoichiometric silicon nitride ($SiN_x$, where x may have a value from about 0.5 to about 1.5), which may be amorphous, or stoichiometric silicon nitride (e.g., $Si_3N_4$, $Si_2N$, SiN or $Si_2N_3$) may be suitable. The sheet may also or alternatively include another material, such as an elemental or compound semiconducting material or a polymer. For example, single crystal films such as InAs/GaAs, InGaAs/GaAs, InGaAsP/InGaAsP, Si—Ge/Si may in some cases be used to form the strained sheet.

Typically, the strained sheet has a thickness of from about 10 nm to about 1 micron (1,000 nm); however, in some embodiments (e.g., in which single crystals may be used), the thicknesses may be about 1 nm or less, down to a few atomic monolayers or to one atomic monolayer. Generally, the thickness is at least about 10 nm, at least about 30 nm, at least about 50 nm, at least about 75 nm, or at least about 100 nm. The thickness may also be no more than about 1 micron, no more than about 800 nm, no more than about 600 nm, no more than about 400 nm, or no more than about 200 nm. When a large number of turns is required and the strained sheet includes two oppositely strained sublayers (a bilayer), it may be advantageous for the sublayers to have the same thickness.

The conductive strip may comprise one or more high conductivity materials selected from the group consisting of carbon, silver, gold, aluminum, copper, molybdenum, tungsten, zinc, palladium, platinum and nickel. In one example, a multilayer conductive structure, such as a Ni—Au—Ni trilayer structure, may be suitable for the conductive strip, where the bottom layer may act as an adhesion layer, the middle layer may act as a conductive layer, and the top layer may act as a passivation/protection layer; typically, adhesion and passivation layers have a thickness of from about 5-10 nm. The high conductivity material may be a two-dimensional material, such as graphene or transition metal dichalcogenides, e.g., $MoS_2$ $MoSe_2$, $WSe_2$ and/or $WS_2$. Such two-dimensional materials can be viewed as free-standing atomic planes comprising just a single monolayer or a few monolayers of atoms. For example, the conductive strip may comprise a few monolayers of graphene formed on a strained $SiN_x$ bilayer, or a single monolayer of graphene may be formed on hexagonal boron nitride, which may replace the strained $SiN_x$ bilayer. It is also contemplated that the conductive strip may comprise carbon nanotubes (in the form of bundles or an array) that may be grown on, for example, a quartz substrate and then transferred to a strained $SiN_x$ bilayer for roll-up.

The conductive strip may include additional tensile strain to facilitate rolling when the sacrificial layer is removed. Advantageously, the conductive strip may be made as thick and smooth as possible to reduce the thin film or sheet resistivity without interfering with the rolling process. The sheet resistivity of the conductive strip may have a significant impact on the performance and size of the rolled-up structure and thus may be kept as low as possible. For example, the sheet resistivity may be about 5 μohm·cm or less.

Typically, the conductive strip has a thickness of at least about 5 nm, at least about 10 nm, at least about 20 nm, at least about 50 nm, at least about 70 nm, or at least about 90 nm. The thickness may also be about 200 nm or less, about 150 nm or less, or about 100 nm or less. For example, the thickness may range from about 10 nm to about 100 nm, or from about 20 nm to about 80 nm. However, in some embodiments, such as those in which the conductive strip comprises a two-dimensional material as discussed above, the thickness may be about 1 nm or less, down to a few monolayers or to one monolayer.

Generally speaking, the length of the conductive strip may be at least about 10 microns, at least about 20 microns, at least about 40 microns, at least about 60 microns, at least about 80 microns, at least about 100 microns, or at least about 150 microns. Typically, the length is no greater than about 2 mm, no greater than 1 mm, no greater than about 500 microns, no greater than 300 microns, or no greater than about 200 microns. For example, the length may range from about 100 microns to about 600 microns, or from about 200 microns to about 500 microns.

The conductive strip may have a width in the range from about 1 micron to about 300 microns, and the width is more typically between about 1 micron and about 100 microns, or between about 1 micron and about 20 microns. Advantageously, the conductive strip to has an aspect ratio (length-to-width) of greater than 1 or much greater than 1.

The substrate may comprise a semiconductor wafer or another rigid material. In some cases, the substrate may be a single crystal substrate comprising a crystallographic plane oriented parallel to the supporting surface and having a preferred etch direction. For a helical antenna formed on (rolled up on) a single crystal substrate, the rolling direction R of the strained sheet may be substantially parallel to the preferred etch direction of the single crystal substrate. As would be known by one of ordinary skill in the art, the preferred etch direction is the crystallographic direction along which etching preferentially occurs when the single crystal is exposed to a suitable chemical etchant. The rolling direction of the rolled configuration may thus be predetermined based on the crystallography of the underlying substrate. The single crystal substrate may be a single crystal bulk substrate that includes an etched surface portion along the preferred etch direction after roll-up. It is also possible for the single crystal substrate to include a single crystal sacrificial layer thereon that is partially or entirely removed along the preferred etch direction during roll-up.

Alternatively, the substrate may be an amorphous substrate or a polycrystalline substrate that does not have a crystallographically preferred etch direction. While etching may still be employed to release the elongate strip to form the rolled configuration, the direction of etching and thus the geometry of the resulting rolled-up structure may be less predictable and/or may depend on other parameters, as discussed below. In this embodiment, as in the previous embodiment, a portion of the substrate may be etched to facilitate roll-up of the elongate strip(s), or the substrate may comprise a sacrificial layer that is removed during roll-up. As indicated above, the substrate may be rigid or flexible. Flexible substrates typically comprise a polymeric material.

When a single crystal substrate is employed, the crystallographic plane oriented parallel to the supporting surface of the substrate may be selected from the {111} family of planes, the {110} family of planes, or from the {100} family of planes. The preferred etch direction may be a <110> direction, a <100> direction, or a <111> direction. For example, in the case of a silicon (111) substrate, which has a (111) plane oriented parallel to the supporting surface, the preferred etch direction may be a <110> direction.

The rolled configuration of the helical antenna may have a diameter (inner diameter) of 100 microns or less, e.g., from about 1 nm to about 100 microns, from about 1 micron to about 50 microns, from about 10 microns to about 30 microns, or from about 3 microns to about 8 microns. Typically, the inner diameter of the rolled configuration is no more than about 80 microns, no more than about 50 microns, no more than about 30 microns, no more than about 20 microns, or no more than about 10 microns. The inner diameter may also be at least about 1 micron, at least about 4 microns, or at least about 8 microns. However, in some embodiments, such as when the strained sheet comprises a single crystal film, the inner diameter of the rolled configuration may be significantly smaller due to the reduced thickness. For example, the inner diameter may be no more than 100 nm, no more than 40 nm, no more than 10 nm, or no more than 5 nm, and typically the inner diameter is at least about 1 nm. Furthermore, as described below, the inner diameter may be reduced after rolling by annealing or other approaches, so as to achieve unprecedented inner diameter-to-thickness ratios.

The helical antenna may include at least about 3 turns, at least about 5 turns, at least about 10 turns, at least about 20 turns, or at least about 40 turns. Typically, the helical antenna includes no more than about 60 turns, no more than 40 turns, or no more than 20 turns. For example, the number of turns may range from about 5 turns to about 20 turns, or from about 5 turns to about 10 turns.

The rolled configuration of the helical antenna has a length along the longitudinal axis that depends on the length of the conductive strip and the helix angle. Typically, the length is in a range from about 1 micron to about 1000 microns. For example, the length may be at least about at least about 5 microns, at least about 50 microns, at least about 100 microns, at least about 300 microns, or at least about 500 microns, and the length may also be about 1000 microns or less, about 800 microns or less, about 600 microns or less, or about 400 microns or less.

Method of Fabrication and Modulation of Size and Shape

Fabrication of the helical antennas is now described in detail. A strained sheet is formed on a supporting surface of a substrate, where the strained sheet comprises a material compatible with standard integrated circuit (IC) processing (e.g., CMOS technology). A conductive strip is formed on the strained sheet such that the conductive strip has a misalignment angle α with respect to a rolling direction. For example, the conductive strip may be formed by vapor deposition of a conductive film followed by photolithographic patterning, as known in the art, to control the orientation and size of the conductive strip. A portion of the substrate is etched, thereby releasing an end of the strained sheet and allowing the sheet and conductive strip to roll up along the rolling direction to relieve strain. Consequently, a strain-relieved sheet with the conductive strip thereon is formed in a rolled configuration about a longitudinal axis, which may be substantially perpendicular to the rolling direction and substantially parallel to the supporting surface of the substrate. The conductive strip has a helical configuration about the longitudinal axis with a non-zero helix angle β.

The strained sheet typically includes an upper portion under tensile stress and a lower portion nearer to the substrate which is under compressive stress. To form the strained sheet, compositional or structural differences may be introduced into sublayers that are successively deposited (e.g., by chemical vapor deposition), as described for example in U.S. Patent Application Publication 2015/0099116 A1, published on Apr. 9, 2015, and hereby incorporated by reference in its entirety.

As shown in FIG. 4A, the strained sheet may be oriented along the rolling direction with only the conductive strip being oriented at the misalignment angle α with respect to the rolling direction R. Alternatively, both the strained sheet and the conductive strip may be oriented at the angle α with respect to the rolling direction R, as shown in FIG. 4B. It is possible to form an array of the helical antennas by forming a row of conductive strips on one or more strained sheets (e.g., where the row extends in an x-direction), and etching a portion of the substrate underlying the row, thereby inducing the strained sheet(s) to roll up and form a one-dimensional (1D) array of helical antennas. A two-dimensional (2D) array of helical antennas may be formed by fabricating multiple rows of the strained sheet(s) (e.g., where the rows repeat along a y-direction).

The substrate may include a sacrificial layer, which may be (a) an additional layer on the substrate between the strained layer and the substrate that is removed during roll-up, or (b) a portion of the substrate adjacent to the strained layer that is removed during roll-up. The sacrificial layer may comprise a material that can be etched without removing or otherwise damaging the strained layer. For example, single crystalline and/or polycrystalline Ge, $GeO_x$, Si, and AlAs, as well as photoresist, may be used as a sacrificial layer. The substrate and/or the sacrificial layer may have an etch rate at least about 1000 times an etch rate of the strained sheet.

It is possible to predetermine the size (e.g., inner diameter, pitch, and/or length) of the helical antenna by controlling the orientation and size of the conductive strip on the strained layer prior to rolling as well as other planar parameters (e.g. number of turns), as described above. In addition, the inventors have developed a method to alter the size and shape of the helical antenna after roll-up in order to modulate one or more performance parameters (e.g., working frequency, gain). This approach may be applied to individual helical antennas as well as to arrays of helical antennas, and, more generally speaking, to wireless communications devices, where the conformation of the antennas and/or the arrays may be altered in order to obtain the desired performance.

The method of modulating the performance of a wireless communications device entails inducing a change in conformation of one or more helical antennas on a supporting surface of a substrate. Each helical antenna comprises, as described above, a strain-relieved sheet in a rolled configuration about a longitudinal axis, where the strain-relieved sheet includes a conductive strip thereon disposed in a helical configuration about the longitudinal axis with a non-zero helix angle β. Inducing the change in conformation comprises altering an inner diameter, pitch, and/or length of at least one of the helical antennas, and/or altering a spacing between adjacent helical antennas. Consequently, a performance parameter of the helical antenna(s), such as working frequency or gain, may be controlled.

The change in conformation may be effected by thermal, electrostatic magnetic and/or cellular force actuation of the one or more helical antennas. Also or alternatively, deformation of an underlying flexible substrate may be employed to induce the change in conformation. Notably, the change in conformation (size and/or shape) may be effected without physically contacting any of the helical antennas.

The phrase "change in conformation of the one or more helical antennas" may refer to a change in size and/or shape of one or more individual helical antennas, or, when a plurality of helical antennas (e.g., an array) is involved, the phrase may refer to a change in size and shape of the array itself. For example, if the one or more helical antennas comprise an array of helical antennas having a predetermined or arbitrary spacing, then inducing a change in conformation thereof may entail altering the array pitch, i.e., the spacing of the helical antennas in the array. The inner diameter, pitch and/or length of at least one of the helical antennas in the array may also be altered.

Figure 5A:
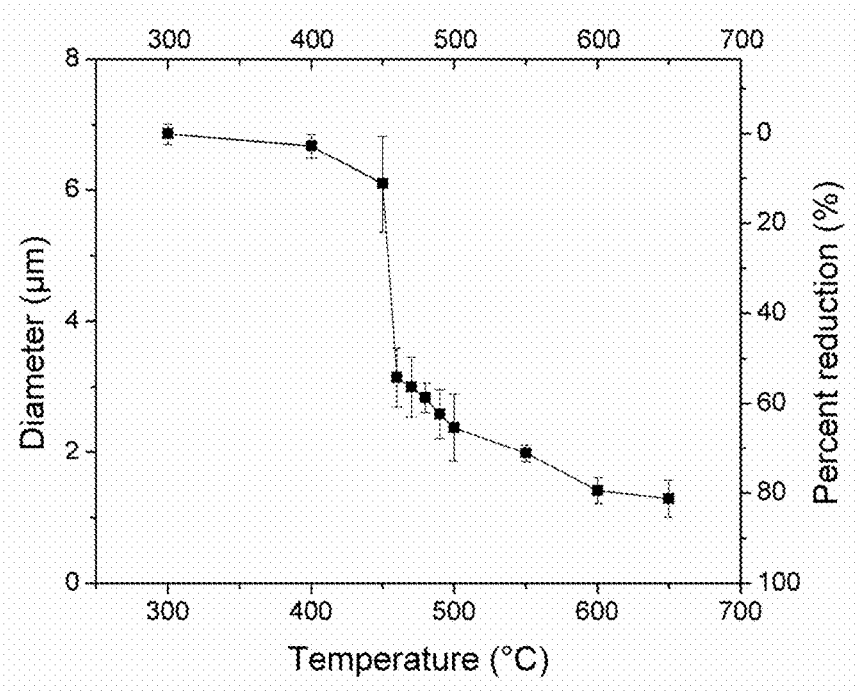
FIG. 5A shows diameter and percent reduction in diameter as a function of temperature for a strain-relieved (rolled-up) sheet that undergoes rapid thermal annealing.
Figure 5B:
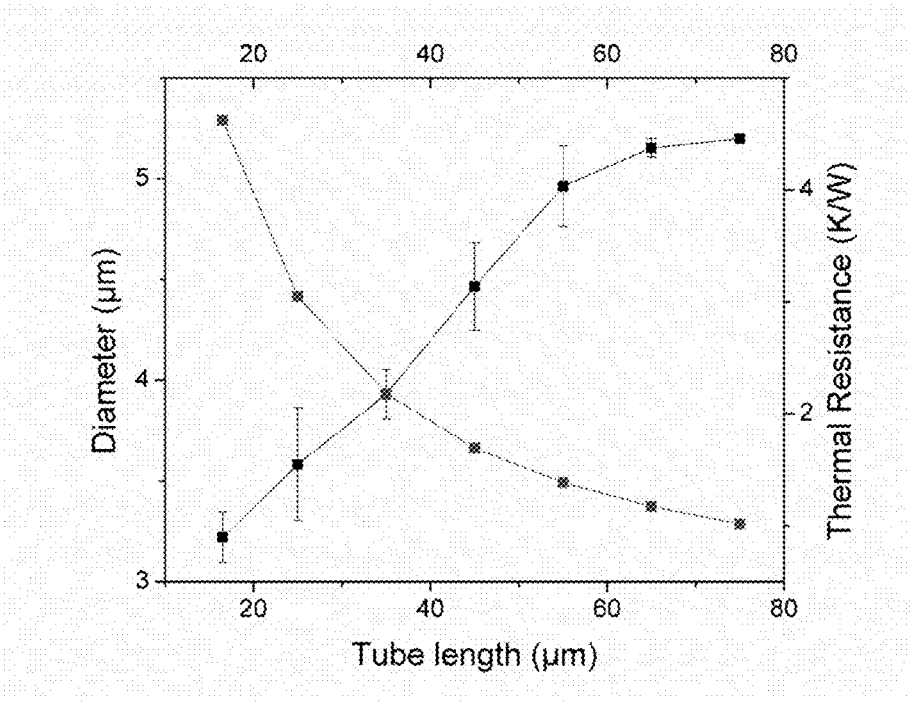
FIG. 5B shows diameter and tube length versus thermal resistance for a strain-relieved (rolled-up) sheet that undergoes rapid thermal annealing.
Figure 6A:
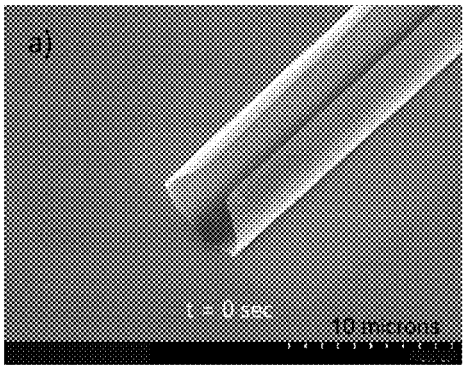
FIGS. 6A and 6B show scanning electron microscope (SEM) images of a rolled-up sheet prior to and after, respectively, excitation by an electron beam.
Figure 6B:
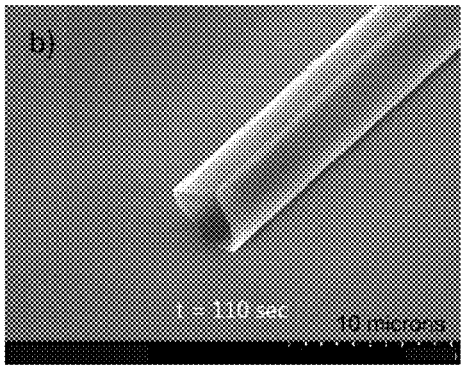

As indicated above, a change in conformation may be effected by thermal, electrostatic, magnetic or cellular force actuation of the one or more helical antennas. For example, heating may be employed to reduce the diameter of the helical antennas, as shown by the data in FIG. 5A, which is obtained from rapid thermal annealing (RTA) of a strain-relieved (rolled-up) $SiN_x$ sheet. A significant diameter reduction is observed at about 460° C. and follows a logarithmic trend to an 80% reduction at 650° C. The data of FIG. 5B show the impact of tube length on the diameter reduction, indicating increased thermal resistance at larger lengths. In other words, at longer lengths, longer heating times or higher temperatures may be needed to achieve the desired diameter reduction. In addition to annealing, electrostatic actuation has been shown to allow for tuning of the diameter or curvature of the rolled configuration. For example, under electron beam excitation for 110 s at 10 kV and 7 μA, a rolled-up $SiN_x$ sheet can change from an open configuration, as shown in FIG. 6A, to a smaller-diameter closed configuration, as shown in FIG. 6B. The process can be reversed under excitation by a positive ion beam.

Figures 7A, 7B, 7C, 7D, 7E:
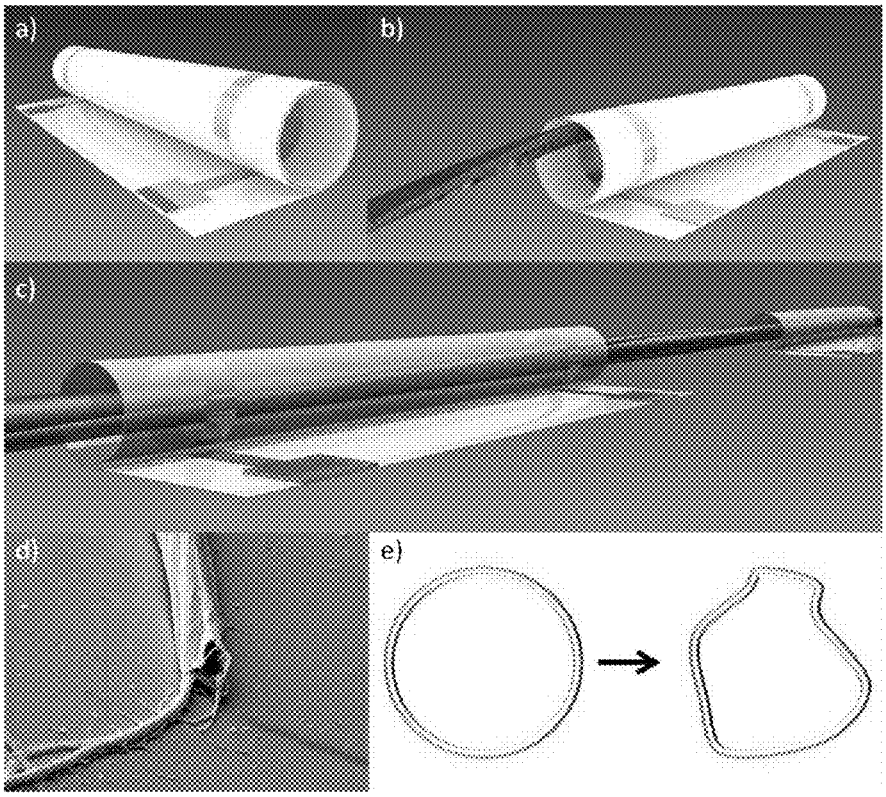
FIGS. 7A-7E reveal the cellular force interaction between cortical neurons and a rolled-up conductive structure (helical or non-helical).

In another example, cellular force actuation may be employed to alter the conformation of the helical antenna(s). For example, cortical neurons may be employed to interact with the helical antenna or with a non-helical rolled-up conductive structure, as shown schematically in FIGS. 7A-7E. FIG. 7A shows a stable microtube of 5 microns in diameter having electrodes spaced apart near an end of the rolled-up conductive structure. In FIGS. 7B and 7C, the rolled-up conductive structure is met by an outgrowth (extension) from a young cortical neuron structure of 1-1.5 microns in diameter and is initially undisturbed. Communication between neurons can then be measured by capacitive, inductive, or resistive methods dependent on electrode geometry. As the neuron structure matures, its extensions grow to sizes that rival the inner diameter of the rolled-up conductive structure, bending the microtube to the morphology of the neuron structure, as shown by the SEM image of FIG. 7D. The schematics of FIG. 7E show the change in radius of the rolled-up conductive structure, where the left hand side figure shows before exposure to the cellular force and the right hand side figure shows after exposure to the cellular force. This change in diameter and morphology can influence the resonance of a helical or radial antenna.

Also or alternatively, the change in conformation may be effected by deformation of an underlying flexible substrate, e.g., by compressing in a plane of the substrate, stretching in the plane of the substrate, and/or by bending the substrate. The deformation may cause a change in inner diameter, pitch and/or length of one or more helical antennas, and/or may cause a change in the spacing of helical antennas in an array.

The relationship between the conformation of a helical antenna and gain is explored using a commercially available finite element method (FEM) solver for electromagnetic structures (High Frequency Electromagnetic Field Simulation (HFSS), ANSYS, Inc.). To avoid higher order mode generation by the feed transmission line, a coaxial feed line with a cross section size significantly smaller than the antenna operating frequency is used in the simulations. The conductive strip is assumed to have zero thickness with an infinitely large conductivity. Since dielectric losses are insignificant compared to ohmic losses, the strain-relieved sheet is not included in the simulations. Also, since substrate effects are negligible, the substrate is not modeled in the simulations. Radiative boundary conditions are used to model the far field radiation.

Figure 8A:
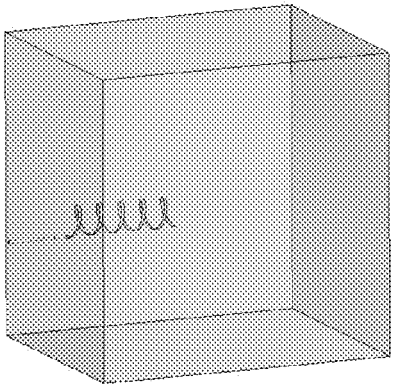
FIG. 8A shows a simulated 5-turn helical antenna with a 50 μm inner diameter and 37.5 μm pitch.
Figure 8B:
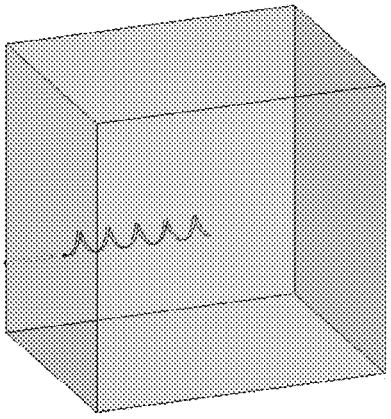
FIG. 8B shows a simulated 5-turn helical antenna with a 37.5 μm inner diameter and 50 μm pitch.
Figure 8C:
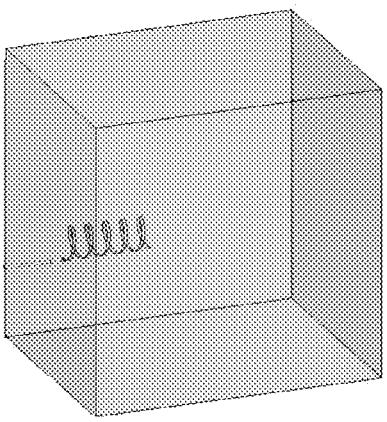
FIG. 8C shows a simulated 5-turn helical antenna with a 54.8 μm inner diameter and 30 μm pitch.
Figure 9A:
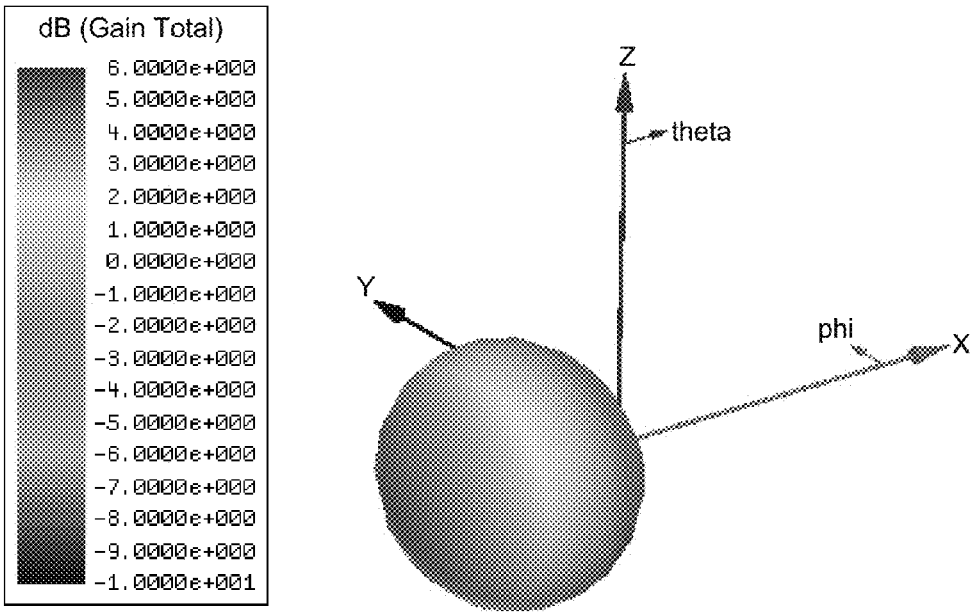
FIGS. 9A-9C show the 3D gain patterns of the helical antennas of FIGS. 8A-8C, respectively.
Figure 9B:
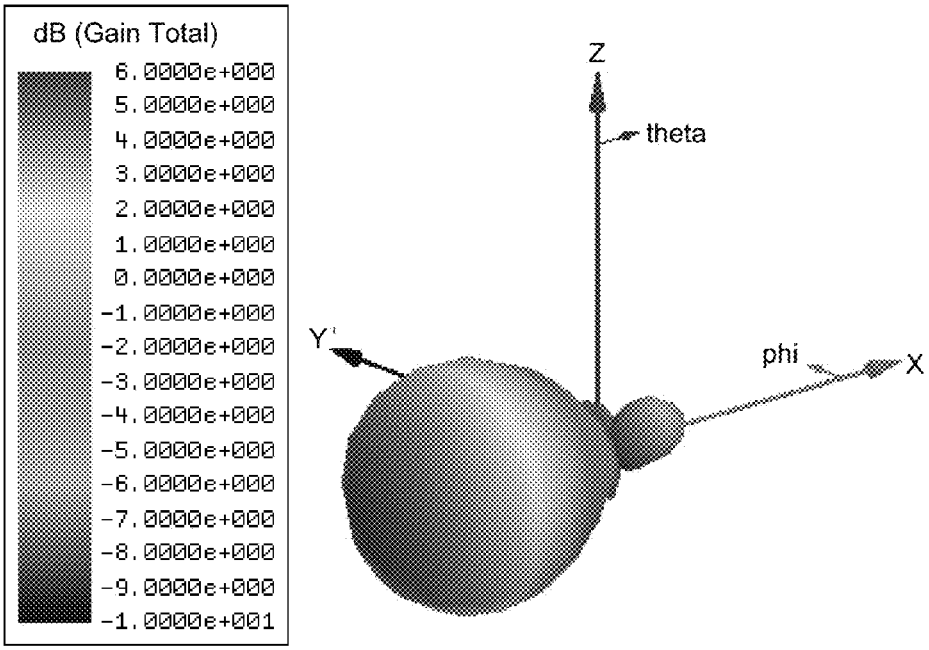
Figure 9C:
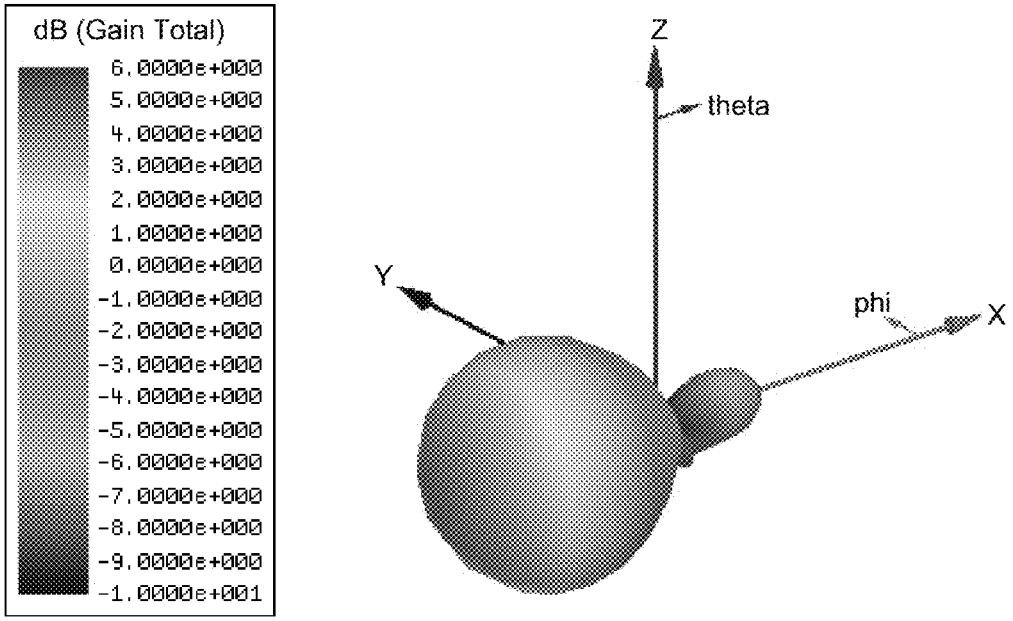

Referring first to FIGS. 8A-8C, it can be seen that different helical antenna structures can be obtained from the same planar layout by modulating the inner diameter, pitch and length of the helical antenna after roll-up. FIG. 8A shows a 5-turn helical antenna with a 50 μm inner diameter and 37.5 μm pitch; FIG. 8B shows a 5-turn helical antenna with a 37.5 μm inner diameter and 50 μm pitch; and FIG. 8C shows a 5-turn helical antenna with a 54.8 μm inner diameter and 30 μm pitch. FIGS. 9A-9C show the 3D gain patterns of the helical antennas of FIGS. 8A-8C, respectively. A helical antenna structure that is not stretched or compressed may have a one-quarter wavelength pitch that is ideal for achieving maximum gain. When the helical antenna structure is stretched or compressed in length, the radiation pattern may be affected and the maximum gain may be reduced. For single-direction communication applications, an as-rolled antenna structure that has a single-lobe radiation pattern, as shown for example in FIG. 9A, may be advantageous. For communications in multiple directions, however, the multi-lobe gain patterns of FIG. 9B or 9C, which may be obtained by stretching or compressing an as-rolled antenna structure, may be preferred. It has been found that a helical antenna structure that is stretched to a higher pitch and smaller diameter may be used at higher working frequencies, while a helical antenna structure that is compressed to a smaller pitch and increased diameter may be used at lower working frequencies.

Figure 10A:
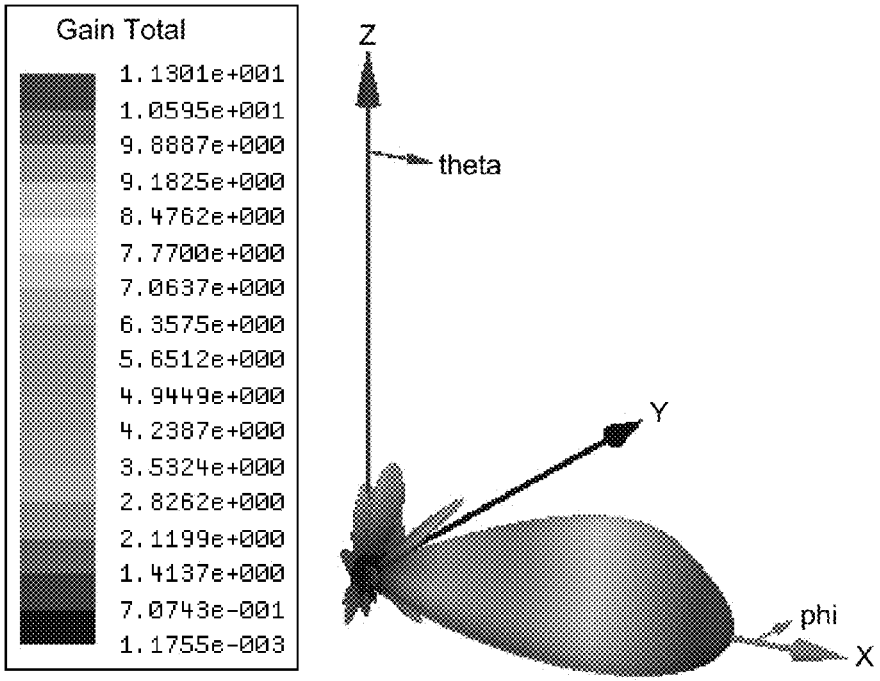
FIGS. 10A-10E show the results of finite element modeling (FEM) simulations for the helical antenna of FIG. 2B, including: 3D gain pattern (FIG. 10A); gain rectangular plot (FIG. 10B); gain and directivity polar plot at $\theta=90°$ (FIG. 10C); gain and directivity polar plot at $\phi=90°$ (FIG. 10D); and E and H plane polar plot at $\phi=90°$ (FIG. 10E).
Figure 10B:
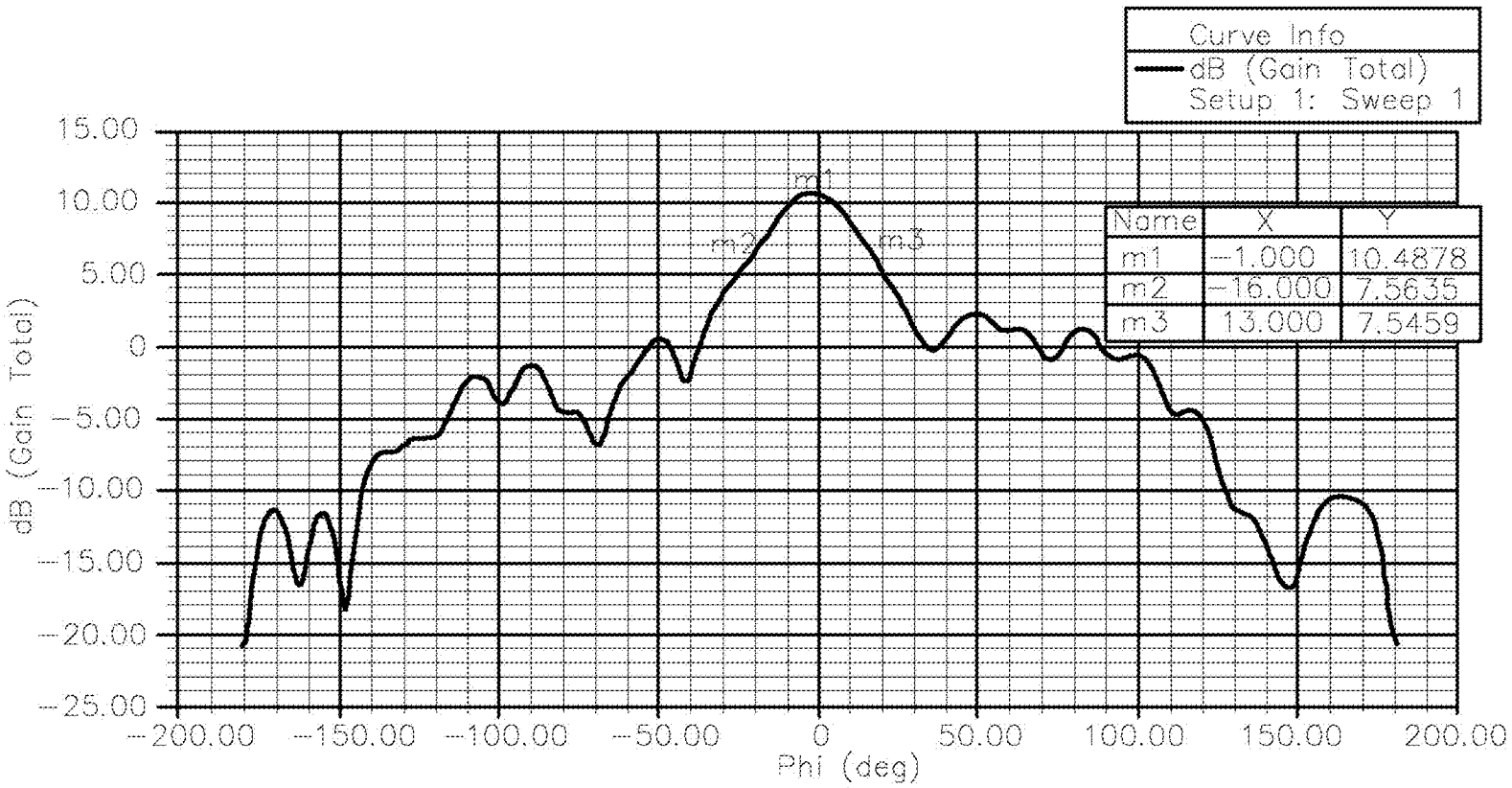
Figure 10C:
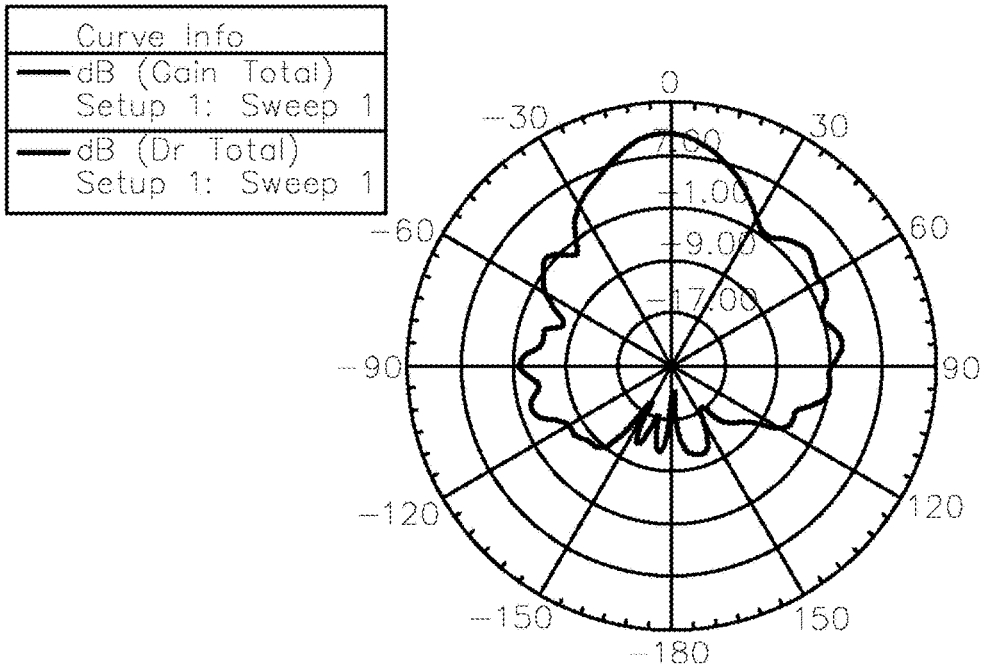
Figure 10D:
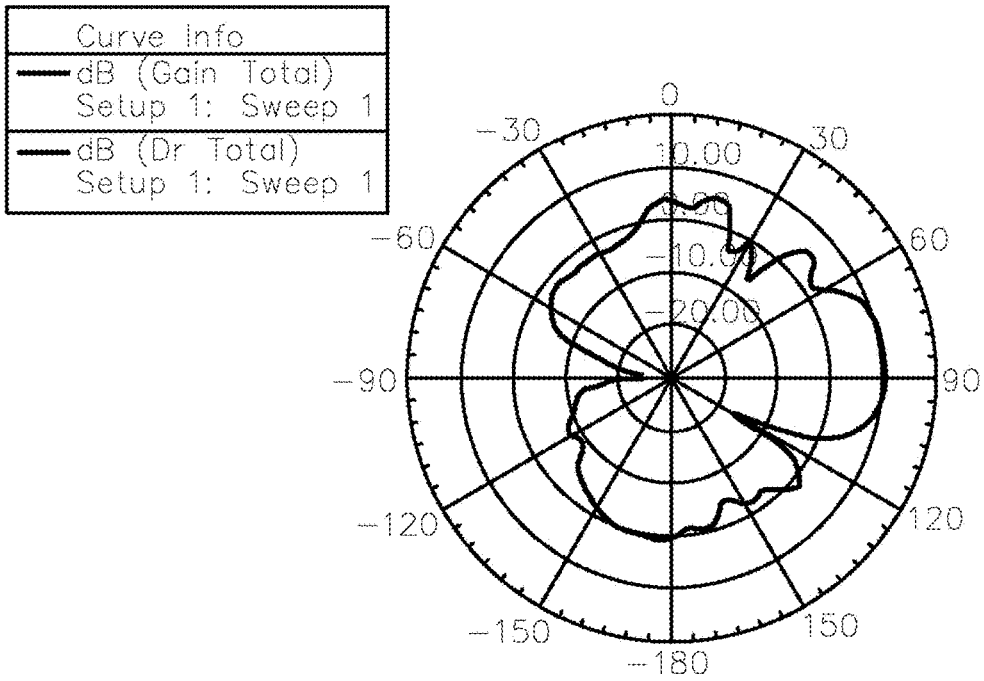
Figure 10E:
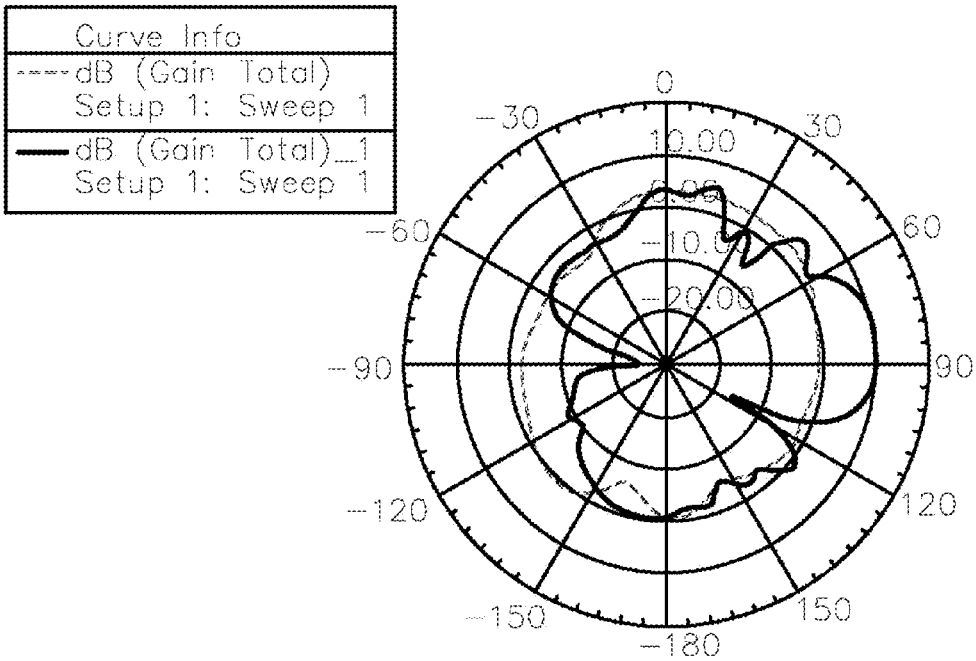

The gain can be enhanced by adding more turns. Referring again to FIG. 2B, the helical antenna of this example includes ten turns, with an inner diameter of 44 μm, a pitch of 39.3 μm and a misalignment angle $\alpha$ of 14°. FIGS. 10A-10E show the results of FEM simulations for this helical antenna structure, including the 3D gain pattern (FIG. 10A), gain rectangular plot (FIG. 10B), gain and directivity polar plot at $\theta$=90° (FIG. 10C), gain and directivity polar plot at $\phi$=90° (FIG. 10D), and E and H plane polar plot at $\phi$=90° (FIG. 10E). For axial mode operation, the maximum gain may be as high as 10.5 dB at 2.15 THz, and the half-power beam width (HPBW) may be about 30° at $\theta$=90°.

Figure 11:
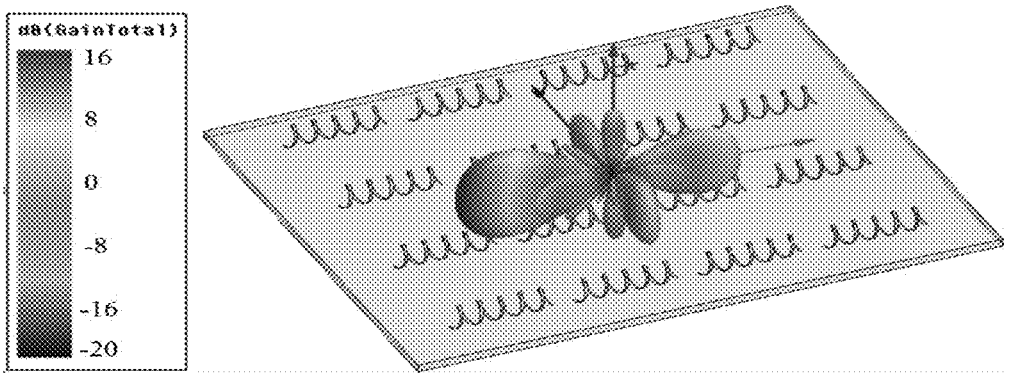
FIG. 11 shows a 3D gain pattern for the array of helical antennas.

The 3D gain pattern for an array of helical antennas is shown in FIG. 11. The array in this example is a two-dimensional, 4×4 array including 5-turn helical antennas of 50 μm inner diameter and 37.5 μm pitch. The maximum gain of 16 dB is obtained at 1.3 THz with an array pitch (or spacing) of 1.5$\lambda$, where $\lambda$ is the working wavelength.

Although the present invention has been described in considerable detail with reference to certain embodiments thereof, other embodiments are possible without departing from the present invention. The spirit and scope of the appended claims should not be limited, therefore, to the description of the preferred embodiments contained herein. All embodiments that come within the meaning of the claims, either literally or by equivalence, are intended to be embraced therein.

Furthermore, the advantages described above are not necessarily the only advantages of the invention, and it is not necessarily expected that all of the described advantages will be achieved with every embodiment of the invention.

The invention claimed is:

1. A helical antenna for terahertz (THz) band applications, the helical antenna comprising:

a strain-relieved sheet including a conductive strip thereon, the strain-relieved sheet and the conductive strip being in a rolled configuration about a longitudinal axis, the conductive strip being oriented at an angle $\alpha$ with respect to a rolling direction so as to comprise a helical configuration about the longitudinal axis with a non-zero helix angle $\beta$, wherein a supporting surface of a substrate underlies the strain-relieved sheet, the longitudinal axis of the rolled configuration being substantially parallel to the supporting surface, and further comprising a transmission line on the supporting surface in contact with the conductive strip for electrical connection to a transmitter or receiver, wherein an inner diameter of the rolled configuration is about 100 microns or less, and wherein the helical antenna comprises a working frequency of at least about 0.1 THz.

2. The helical antenna of claim 1, wherein the substrate comprises a semiconductor wafer.

3. The helical antenna of claim 1, wherein the substrate comprises a flexible substrate.

4. The helical antenna of claim 1, wherein the strain-relieved sheet comprises an inorganic material compatible with integrated circuit (IC) processing.

5. The helical antenna of claim 1, wherein the conductive strip comprises a high conductivity material selected from the group consisting of: carbon, silver, gold, aluminum, copper, molybdenum, tungsten, zinc, palladium, platinum and nickel.

6. The helical antenna of claim 1, wherein the conductive strip comprises a two-dimensional material.

7. The helical antenna of claim 1 exhibiting a maximum gain in a range from about 4 dB to about 11 dB.

8. A method of fabricating a helical antenna for terahertz (THz) band applications, the method comprising:

forming a strained sheet comprising a material compatible with integrated circuit (IC) processing on a supporting surface of a substrate;

forming a conductive strip on the strained sheet, the conductive strip being oriented at a misalignment angle $\alpha$ with respect to a rolling direction;

etching a portion of the substrate, thereby releasing an end of the strained sheet and allowing the strained sheet to roll up along the rolling direction to relieve strain, and forming a strain-relieved sheet including the conductive strip thereon in a rolled configuration about a longitudinal axis, the conductive strip comprising a helical configuration about the longitudinal axis with a non-zero helix angle β, wherein a plurality of the strained sheets are formed on the supporting surface, and wherein an array of helical antennas is formed upon roll-up of the strained sheets.

9. The method of claim 8, wherein both the strained sheet and the conductive strip are oriented at the misalignment angle α with respect to the rolling direction R.

10. The method of claim 8, wherein the strained sheet is oriented along the rolling direction and only the conductive strip is oriented at the misalignment angle α with respect to the rolling direction R.

11. A method of fabricating a helical antenna for terahertz (THz) band applications, the method comprising:

forming a strained sheet comprising a material compatible with integrated circuit (IC) processing on a supporting surface of a substrate;

forming a conductive strip on the strained sheet, the conductive strip being oriented at a misalignment angle α with respect to a rolling direction;

etching a portion of the substrate, thereby releasing an end of the strained sheet and allowing the strained sheet to roll up along the rolling direction to relieve strain, and forming a strain-relieved sheet including the conductive strip thereon in a rolled configuration about a longitudinal axis, the conductive strip comprising a helical configuration about the longitudinal axis with a non-zero helix angle β, wherein the strained sheet is oriented along the rolling direction and only the conductive strip is oriented at the misalignment angle α with respect to the rolling direction R.

* * * * *